US007496981B2

(12) United States Patent
Alonso Cucurull

(10) Patent No.: US 7,496,981 B2
(45) Date of Patent: Mar. 3, 2009

(54) FOAM SPRING MATTRESS

(76) Inventor: Ricardo Alonso Cucurull, c/Victor De La Serna 3-5 (parking), Madrid (ES) 28016

( * ) Notice: Subject to any disclaimer, the term of this patent is extended or adjusted under 35 U.S.C. 154(b) by 314 days.

(21) Appl. No.: 10/558,443

(22) PCT Filed: Jul. 19, 2004

(86) PCT No.: PCT/ES2004/000338

§ 371 (c)(1),
(2), (4) Date: Nov. 28, 2005

(87) PCT Pub. No.: WO2005/011442

PCT Pub. Date: Feb. 10, 2005

(65) Prior Publication Data

US 2006/0248652 A1 Nov. 9, 2006

(30) Foreign Application Priority Data

Jul. 31, 2003 (ES) ..... 200301824

(51) Int. Cl.
*A47C 27/15* (2006.01)

(52) U.S. Cl. ..... 5/740; 59/719; 59/727; 59/655.9; 59/730

(58) Field of Classification Search ..... 5/730, 5/727, 655.9, 724, 719, 740; 267/143, 145
See application file for complete search history.

(56) References Cited

U.S. PATENT DOCUMENTS 4,194,255 A * 3/1980 Poppe ..... 267/153
4,901,387 A * 2/1990 Luke ..... 5/730
5,007,124 A * 4/1991 Raburn et al. ..... 5/731
6,541,094 B1 * 4/2003 Landvik et al. ..... 428/71
7,000,277 B2 * 2/2006 Torres Cervera ..... 5/719

FOREIGN PATENT DOCUMENTS

| | | |
|---|---|---|
| DE | 19919502 C1 | 6/2000 |
| EP | 0367607 A1 | 5/1990 |
| ES | 0186551 U | 3/1923 |
| ES | 10282120 U | 12/1994 |

* cited by examiner

*Primary Examiner*—Alexander Grosz

(57) ABSTRACT

The mattress (1) is made of a block of flexible polyurethane foam (4) with a density of 40 Kg/m$^3$ or of any other density, said block being firstly cut with a cut programmable automatic machine, by the main side and then turned at a 90° degree angle by its small side. A certain amount of springs (5) is thereby formed depending on each type of mattress (1).

The amount of spirals (5.1) of every spring (5) depends on the position of each spring in the mattress (1) with the purpose of varying the flexibility thereof so that the mattress (1) can perfectly adapt to the contour to of every user or so that the flexibility can remain constant throughout the entire mattress. Multiple variations can be realized while the height of the mattress remains the same (less spirals having the same spiral thickness and more base and uncut, etc.; the width of a spiral can be changed, as well as the number of spirals, the inclination of the axis of the spirals, the total height of an area-budge or cavity, etc. The upper surface of the product is covered with a viscous elastic layer (3) of polyurethane with a 50 Kg/m$^3$ density, 4 cm thickness and threaded padding (2).

3 Claims, 6 Drawing Sheets

FOAM SPRING MATTRESS

OBJECT OF THE INVENTION

This invention relates to a new type of mattress, completely made of foam, synthetic rubber, etc., and which is provided with a number of springs made up of the same material as that of the mattress itself.

BACKGROUND OF THE INVENTION

There are currently a great number of types of mattresses on the market that ensure giving people's bodies beneficial rest, and which also must fulfil the function of giving people proper support, being neither too soft nor too hard. The main varieties are the following:

- Wool mattress: currently they are produced very infrequently, because wool has been replaced by new materials. This type of mattress has as a drawback that with use, the wool becomes lumpy and that every two or three years it has to be re-carded so as to restore its consistency. In addition, mattress makers are very scarce nowadays.
- Spring mattress: it is made of steel springs that can be bi-conical (the upper and lower turns are bigger than the central ones), or helical (the turns have all got the same diameter), and they are often individually isolated in order to prevent noise. On either side of the springs, the filling-holder is lined with a layer of horsehair, sisal or felt; a cotton, wool or synthetic fibre filling, which in turn are also lined; and finally, the whole assembly is closed into the outer cover. These mattresses are solid and comfortable.
- "Multi-elastic" mattresses differ from those of traditional springs in that they have a kind of thick net of metallic thread.
- Synthetic latex mattress: a chemical reconstruction of natural latex. These mattresses have a flat surface, and another one full of cells that facilitate air circulation. They are very hygienic, but sensitive to light when they are exposed to it without their covers.
- Polyester mattress: the density of polyester used for producing mattresses must not be less than 25 kg/m$^3$. The softness of the foam depends on this density. Since the regulations are not always respected, this type of material has acquired an undeservedly bad reputation. Before buying one of these mattresses, the consumer should insist that the density of the foam rubber should be specified. It should also have a thickness of, at least, 10 cm to be of good quality.

With the objective of solving the described problems, a new type of mattress has been developed, which is described below.

DESCRIPTION OF THE INVENTION

This invention consists of a new type of mattress that is made from a block of flexible polyurethane foam of 40 Kg/m$^3$ or of any other density, and later with an automatic programmable machine, the interior of said block is cut first on its larger side and later turning the block 90°, or turning to another angle in which case the springs would remain in an oblique arrangement, by the smaller side or vice-versa, thus forming a certain quantity of springs that depends on the size of each type of mattress. It can also be produced by injection, or by any other method.

The number of turns that each spring has depends on the position of each one within the mattress with the objective of varying its flexibility and that the mattress should adjust perfectly to the shape of every individual person in a first shape of the mattress. However, in a second shape of the mattress designed to use each block of polyurethane foam entirely, the springs have the same number of turns throughout the entire surface of the mattress and the pressure created by each spring will depend on its deformation, being greater the more it is compressed, adjusting itself to the pressure points of the person who will be using it, reducing the pressure where other mattresses do not have such flexibility.

The nucleus of this type of spring mattress is made of a single piece and with a single material, or starting with a block that can be made by gluing pieces of different materials and densities. The product is completed on its upper face with a visco-elastic layer of flexible polyurethane of 50 Kg/m$^3$ and 4 cm thick; or else the nucleus can be finished with a flat shape using the same material as the block, and finally it can optionally include a three-dimensional knit padding.

The densities of the aforementioned materials are average values, these mattresses being amenable to the use of other, similar materials and with different densities depending on the desired reduction of pressure in the support areas.

This mattress offers a number of advantages with respect to traditional mattresses, which are the following:

- They only sink down in the areas where they receive pressure. This property is maximally useful when the mattress is used by a couple with relatively different weights, thus preventing the person that weighs less from sliding towards the person that weighs more, maintaining the pressure in a proportional manner while avoiding deforming the mattress.
- It facilitates changing position.
- It facilitates adequate blood circulation, decreasing the pressure placed on the skin and greatly reducing the appearance of bedsores, and likewise decreasing the healing period of patients that already suffer from bedsores.
- They relieve the pain of patients that suffer from bone fragility
- Comfortable and adaptable to the body.
- Greater durability than traditional spring mattresses.
- Free from toxic substances. It is totally innocuous upon body contact.
- Bactericide. Anti-allergenic. Fireproof. Recyclable.

This type of spring cut from a block of foam can be used not only for mattresses but also for any other kind of padded furniture, such as chairs, armchairs, seats, backrests and lower back support for vehicle seats, or for accessories such as pillows or cushions, whether they are conventional, wedge-shaped or cervical, neck supports, etc.

DESCRIPTION OF THE DRAWINGS

In order to complete the description of the invention and with the objective of improving the understanding of its characteristics, a set of figures is attached in which in a purely illustrative and non-limiting manner, the following are represented.

DETAILED DESCRIPTION OF THE INVENTION

Figure 1A:
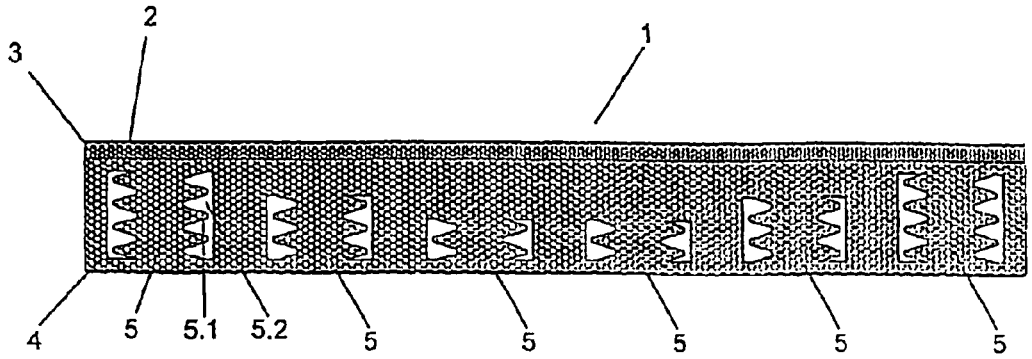
FIG. 1A is a view from the larger side of a two-place mattress (1) of polyurethane foam (4). The upper surface of the mattress (1) has a polyurethane visco-elastic layer (3) and padding (2). The springs (5) and the hollowed-out area (5.2) are shown, the outline of which is formed by the turns (5.1) of each spring (5).
Figure 1B:
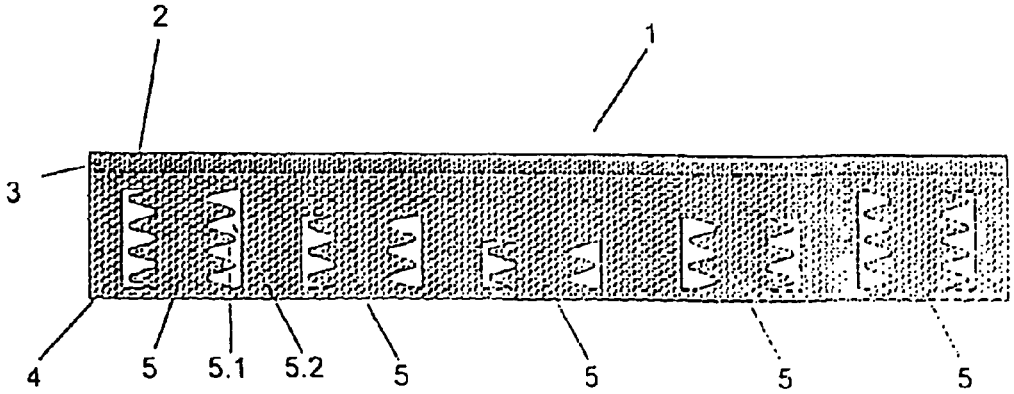
FIG. 1B is a view of the smaller side of a two-place mattress (1) of polyurethane foam (4). The upper surface of the mattress (1) has a layer of visco-elastic polyurethane (3) and padding (2). The springs (5) and the hollowed-out area (5.2) are shown, the outline of which is formed by the turns (5.1) of each spring (5).
Figure 2A:
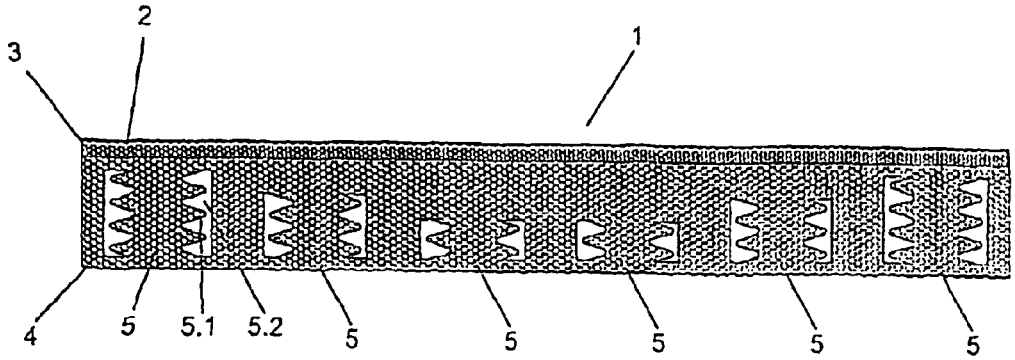
FIG. 2A is a view of the larger side of a one-place mattress (1) of polyurethane foam (4). The upper surface of the mattress (1) has a layer of visco-elastic polyurethane (3) and padding (2). The springs (5) and the hollowed-out area (5.2) are shown, whose outline is formed by the turns (5.1) of each spring (5).
Figure 2B:
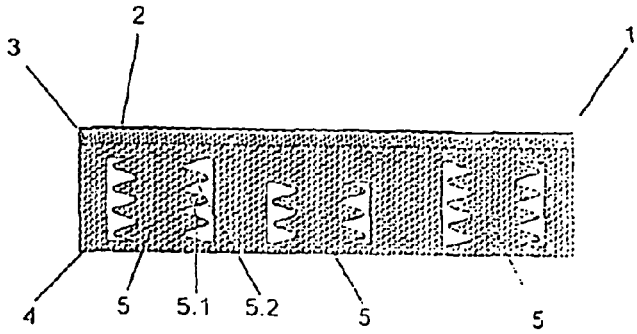
FIG. 2B is a view of the smaller side of a one-place mattress (1) of polyurethane foam (4). The upper surface of the mattress (1) has a layer of visco-elastic polyurethane (3) and padding (2). The springs (5) and the hollowed-out area (5.2) are shown, whose outline is formed by the turns (5.1) of each spring (5).
Figure 3A:
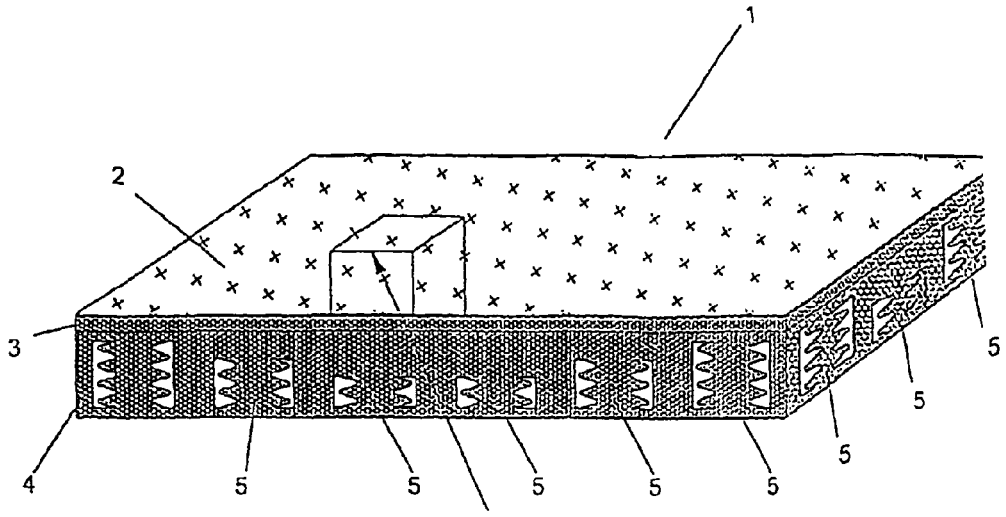
FIG. 3A is a perspective view of a two-place mattress (1) of polyurethane foam (4). The upper surface of the mattress (1) has a layer of visco-elastic polyurethane (3) and padding (2). The distribution of the springs (5) is also visible on the larger side and on the smaller side of the mattress (1).
Figure 3B:
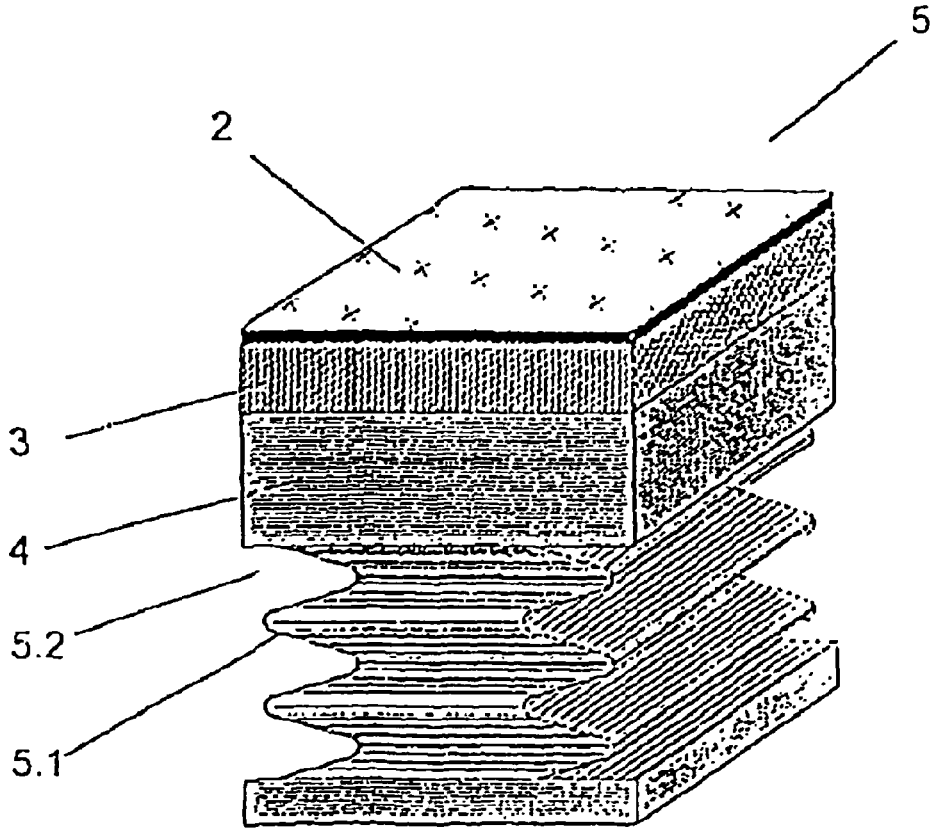
FIG. 3B is the enlarged view of a spring (5) cut out of the interior area of a mattress (1) of polyurethane foam (4), in which the turns (5.1) and the hollowed-out area (5.2) are detailed. The layer of visco-elastic polyurethane (3) and the padding (2) are also visible.
Figure 4:
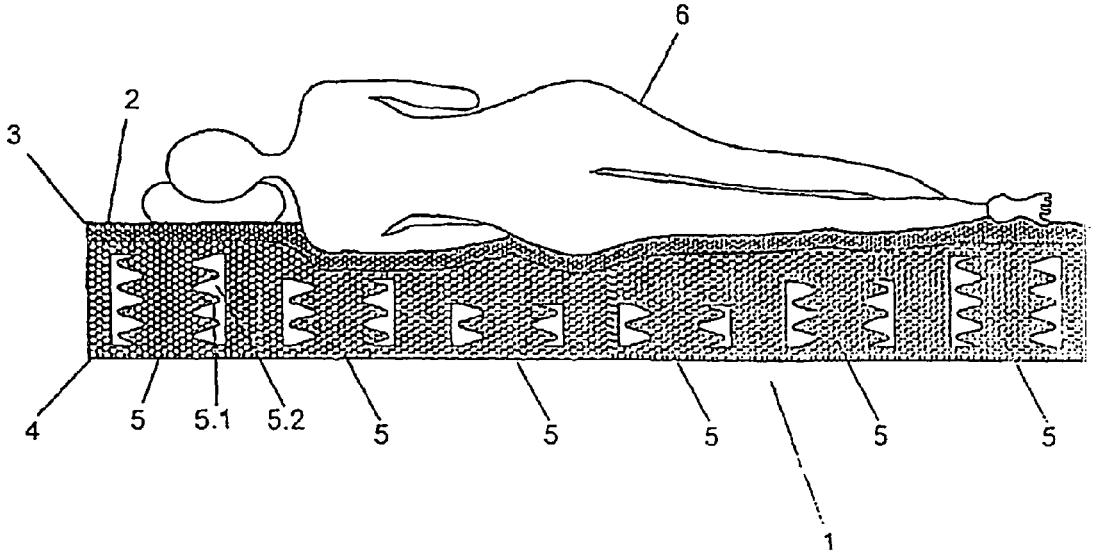
FIG. 4 is the profile view of a mattress (1) of polyurethane foam (4) with the springs (5), the spirals (5.1), the hollowed-out area (5.2), the layer of visco-elastic polyurethane (3) and the padding (2). It is also shown how the mattress (1) adapts perfectly to the shape of the person (6) resting on it.

Among the different types of spring mattresses that can be built based on this invention, the preferred embodiments are those described below.

In a first preferred embodiment (FIGS. 1A-4), starting with a block of polyurethane foam (4) with a density of 40 Kg/m$^3$ or that which is in accordance with the use and the model and size of each mattress (1), the turns (5.1) are cut with an especially designed machine removing exceeding material from the hollowed-out areas (5.2) and shaping the springs (5).

In order for each spring (5) to be shaped, the machine must first carry out the turn (5.1) cutting along the larger side of the mattress (1) and later along the smaller side. In this way, the four sides of each spring are perfectly cut and shaped.

In a second preferred embodiment, the starting point is a parallelepiped rectangular block of polyurethane or other material, in accordance with the length and width that the final mattress should have, with a density of 40 kg/m$^3$ or that which is appropriate in accordance with its use, and it is cut by way of a blade that covers all of the length or width of the block, maneuvered by an arm and a programmable machine.

Figure 5:
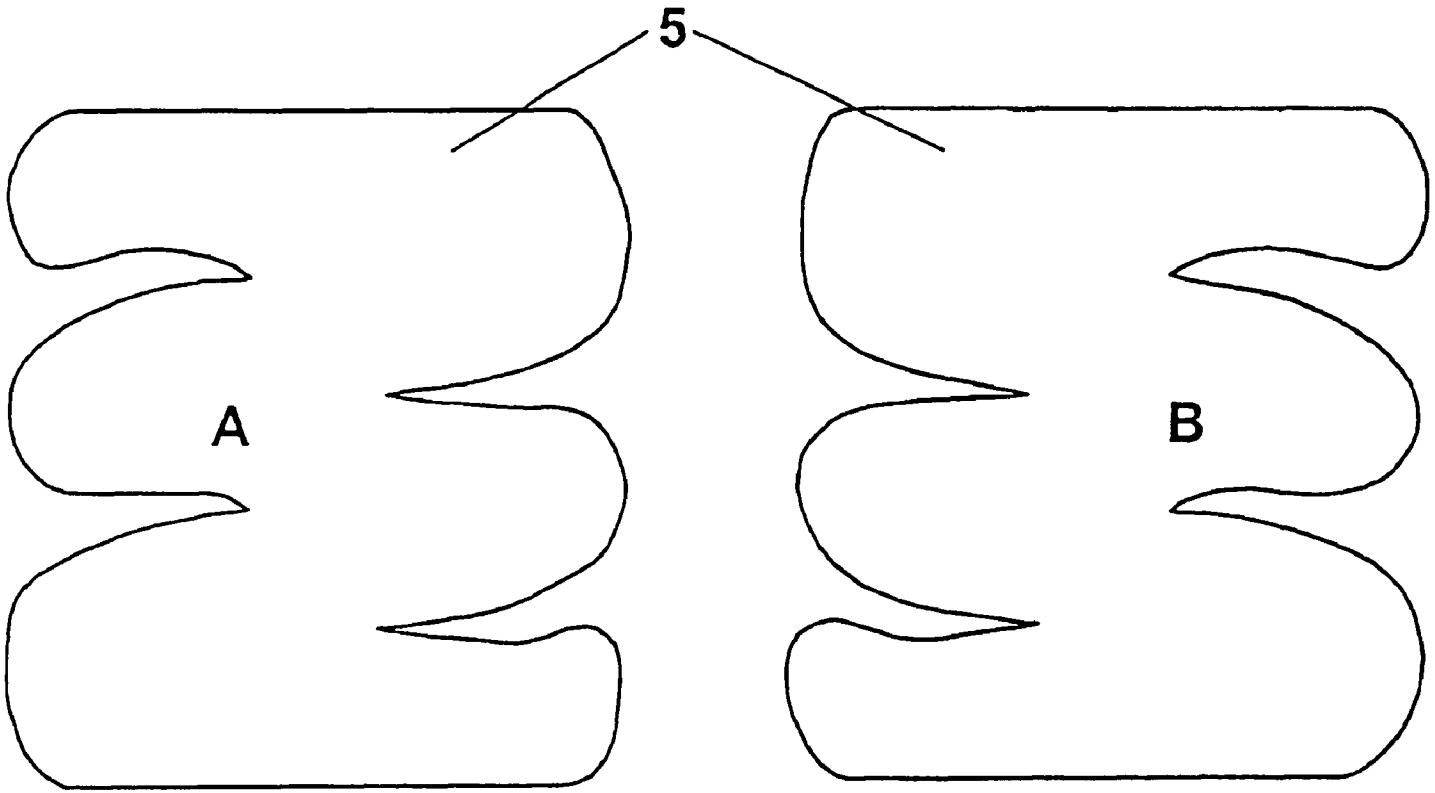
FIG. 5 illustrates another, alternative form of mattress spring with lines that facilitate its use in mattresses of lesser thickness, such as cot mattresses. They are compressed as the aforementioned ones, and are three-dimensional, and are made with parallel and/or non-parallel cuts on two faces of the block as shown.

FIG. 5 illustrates an alternative form of mattress spring with lines that facilitate its use on mattresses of lesser thickness, such as cot mattresses.

Figure 6:
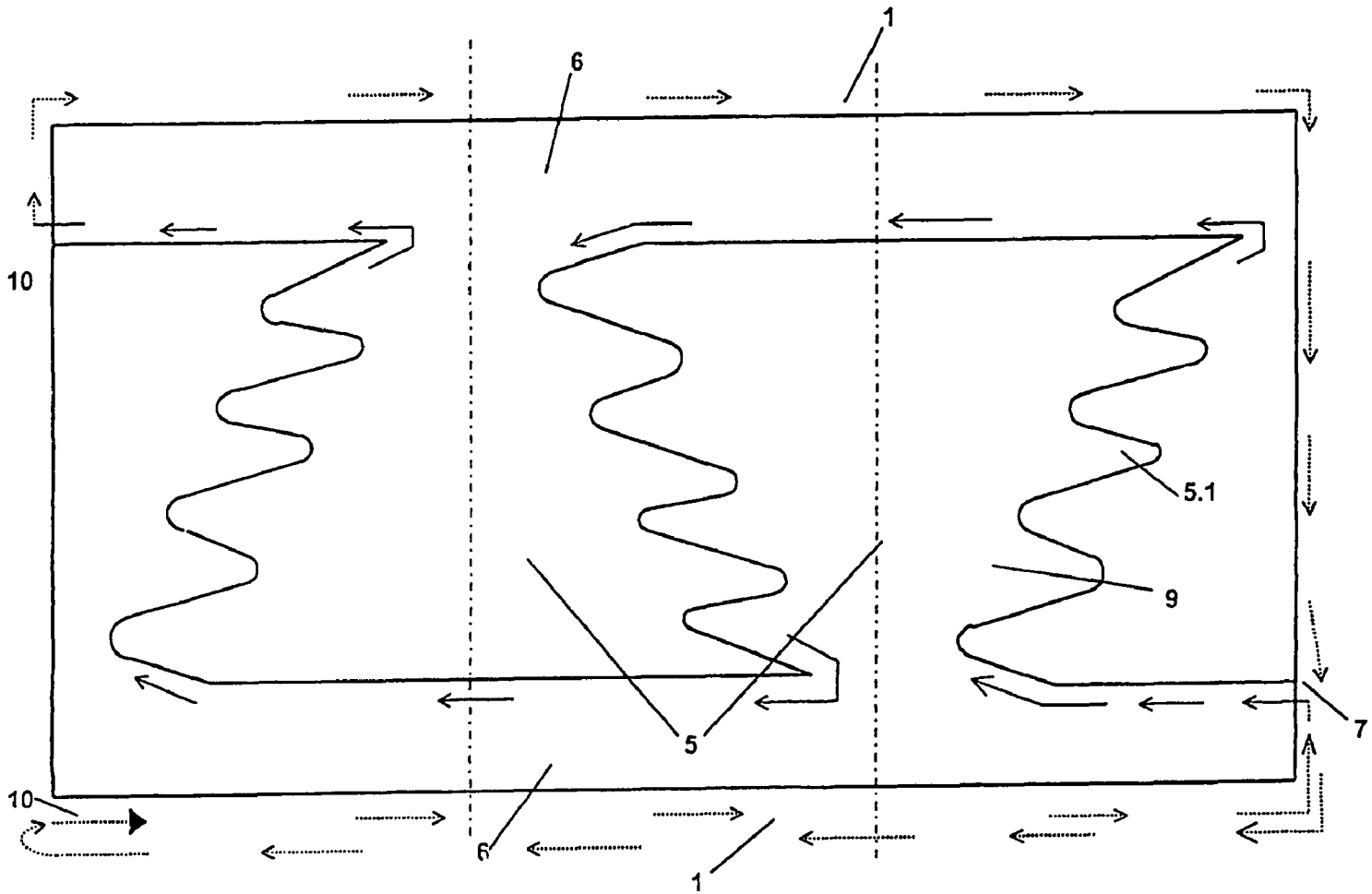
FIG. 6 illustrates in a schematic manner an alternative form for the mattress of the invention where it can be seen how, within a parallelepiped block of polyurethane or other material, it can be made by cutting out two parts, each of them constituting the nucleus of a pyramid-trunk type spring mattress, the springs of each piece being complementary to the other piece with which it formed the block.

In FIG. 6, by way of the solid-line arrows, the course of the blade in relation to one of the lateral sides of the block is shown, though only partially. The blade attacks the block at the tip (7) and cuts the lateral walls of a pyramid trunk (9), the walls of which are not straight but rather zigzagged, with the particular feature that on the opposite wall, the zigzag is displaced with respect to the other wall so that the most salient part of one substantially coincides with the inward part of the other, thus imitating the structure of a traditional spring of elastic material. After cutting out as many lateral walls as have been programmed, the blade is removed from the block at the tip (8) and returns to starting position (10).

It should be noted that up to now the block has been cut into two equal, complementary pieces formed by a platform (6) from which the pyramid trunks (9) jut out, which up to now only have two faces formed, one fitted into the other.

The block is then turned 90° on a vertical axis and the same process is carried out, so that the pyramid trunks (9) that form the springs (5) are completely cut out with four lateral zigzagging walls and the two bodies or nuclei of the mattress (1) that are formed by this process are completely separated. It is noteworthy that in this procedure, as well as forming two mattresses (1) at once, there is a minimal waste of polyurethane block mass or of other material, because both mattresses (1) are equal and complementary. For example, two mattresses (1) can be obtained from a 173 mm-thick block, made up of a 25 mm-thick platform (6) and with a total height of 148 mm, thus making use of 100% of the material. More specifically, two mattresses (1) of 180×900×1900 can be obtained from a block of 210×900×2000 mm; from which, as can be seen, 30 mm of thickness is lost due to the platforms (6), 100 mm in length due to a border (not shown) that is a result of the cutting process and is not usable, and no width at all is lost in the mattresses formed with respect to the width of the original block.

To finalise the production of the mattress (1), once the springs (5) have been cut, an upper layer of visco-elastic polyurethane (3) can optionally be adhered to said mattress (1), including knit padding (2).

Having sufficiently described the nature of this invention, as well as a practical application of the same, it only needs be added that modifications may be added in both its shape and its materials, as well as its production procedure, as long as these modifications do not substantially affect the characteristics claimed below.

The invention claimed is:

1. Polyurethane foam spring mattress (1), comprising a nucleus made from a single block of said material having a plurality of springs (5) with pairs of mutually opposite zigzagged walls, being said zigzag of a first wall of each pair displaced with respect to said zigzag of a second wall of the same pair in such a way that each protruding part of said first wall zigzag coincides substantially with an inward part of said second wall of the same pair; a visco-elastic layer of flexible polyurethane foam 4 cm thick adhered on top of said nucleus; and a three dimensional knit padding.

2. Polyurethane foam spring mattress (1) according to claim 1, wherein the springs (5) of said mattress have the shape of the trunk of a pyramid (9) with pairs of mutually opposite zigzagged walls, and wherein a pair of said nuclei having said plurality of springs are shaped in one process from said block of polyurethane foam by means of a programmable machine with a blade covering the entire length or width of said polyurethane block, said blade cutting firstly a first pair of mutually opposite zigzagged walls of said springs (5) along a longitudinal dimension of said block and secondly along a transversal dimension of said block, whereby both nuclei of said pair of nuclei having said plurality of truncated pyramidal springs are complementary and substantially equal, and said pair of nuclei use substantially the entire block of polyurethane foam.

3. Polyurethane foam spring mattress according to claim 1, wherein said nucleus having said plurality of springs is made up from said block of polyurethane foam by means of an automatic programmable machine that cuts interiorly along a larger side of said block a first pair of mutually opposite zigzagged walls of said springs and, turning said block 90°, said programmable machine cuts interiorly along a smaller side of said block a second pair of mutually opposite zigzagged walls of said springs, and exceeding material is removed from inside said block, whereby said plurality of springs is formed internally to said block and the number of turns of said springs depends on the position of each spring along said larger and smaller sides.

* * * * *